US007467747B2

(12) United States Patent
Haas et al.

(10) Patent No.: US 7,467,747 B2
(45) **Date of Patent: *Dec. 23, 2008**

(54) METHOD AND SYSTEM FOR PROTECTING PRIVACY OF SIGNATURES ON MAIL BALLOTS

(75) Inventors: Bertrand Haas, New Haven, CT (US); Bradley R. Hammell, Fairfield, CT (US); Jay Reichelsheimer, Shelton, CT (US); Frederick W. Ryan, Jr., Oxford, CT (US); Robert A. Cordery, Danbury, CT (US); Matthew J. Campagna, Ridgefield, CT (US)

(73) Assignee: Pitney Bowes Inc., Stamford, CT (US)

( * ) Notice: Subject to any disclaimer, the term of this patent is extended or adjusted under 35 U.S.C. 154(b) by 56 days.

This patent is subject to a terminal disclaimer.

(21) Appl. No.: 11/641,179

(22) Filed: Dec. 19, 2006

(65) Prior Publication Data

US 2008/0142594 A1 Jun. 19, 2008

(51) Int. Cl.
*G06K 19/06* (2006.01)

(52) U.S. Cl. ..... 235/491; 235/386; 235/454; 283/116; 229/71; 229/300; 229/301; 229/303; 229/304

(58) Field of Classification Search ..... 235/491, 235/386, 454; 229/71, 300, 301, 303, 304; 283/116

See application file for complete search history.

(56) References Cited

U.S. PATENT DOCUMENTS

| | | | | |
|---|---|---|---|---|
| 3,186,735 | A * | 6/1965 | Hanrahan | 462/64 |
| 4,597,591 | A | 7/1986 | Gendron et al. | |
| 5,015,318 | A * | 5/1991 | Smits et al. | 156/233 |
| 5,294,470 | A * | 3/1994 | Ewan | 428/41.6 |
| 5,811,792 | A * | 9/1998 | Verschuur et al. | 250/223 R |
| 6,447,015 | B1 * | 9/2002 | Linnewiel | 283/81 |
| 7,240,835 | B2 * | 7/2007 | Brucker et al. | 235/386 |
| 2005/0061866 | A1 | 3/2005 | Ackley et al. | |

* cited by examiner

*Primary Examiner*—Uyen-Chau N Le
*Assistant Examiner*—Tuyen K Vo
(74) *Attorney, Agent, or Firm*—Brian A. Lemm; Angelo N. Chaclas

(57) ABSTRACT

Methods and systems that provide privacy of signatures on envelopes containing ballots are provided. The envelope for returning ballots includes a flap with a window that aligns with a signature area on the envelope. The window appears opaque under normal lighting conditions, but appears transparent when illuminated with light having a predetermined wavelength. A movable signature stub is positioned on top of the signature area. The voter signs the back of the envelope on the signature stub, thereby imprinting a signature on the signature area by transferring a material from the signature stub to the signature area, and moves the signature stub. The flap of the envelope is then sealed, thereby covering the voter's signature in the signature area with the window of the envelope flap. To read the signature, light having the predetermined wavelength can be directed onto the window, thereby rendering the window transparent and the signature visible.

25 Claims, 8 Drawing Sheets

METHOD AND SYSTEM FOR PROTECTING PRIVACY OF SIGNATURES ON MAIL BALLOTS

FIELD OF THE INVENTION

The invention disclosed herein relates generally to voting systems, and more particularly to a method and system for protecting privacy of signatures on ballots sent through the mail.

BACKGROUND OF THE INVENTION

In democratic countries, governmental officials are chosen by the citizens in an election. Conducting an election and voting for candidates for public office in the United States can be performed in several different ways. One such way utilizes mechanical voting machines at predetermined polling places. When potential voters enter the predetermined polling place, voting personnel verify that each voter is properly registered in that voting district and that they have not already voted in that election. Thus, for a voter to cast his vote, he must go to the polling place at which he is registered, based on the voter's residence. Another method for conducting an election and voting utilizes paper ballots that are mailed to the voter. The voter marks the ballot and returns the ballot through the mail. Mailed ballots have been historically reserved for absentee voting. In the usual absentee voting process, the voter marks the ballot to cast his/her vote and then inserts the ballot in a return envelope which is typically pre-addressed to the voter registrar office in the corresponding county, town or locality in which the voter is registered. The voter typically appends his/her signature on the back of the envelope adjacent to his/her human or machine readable identification.

When the return envelope is received at the registrar's office, a voting official compares the voter signature on the envelope with the voter signature retrieved from the registration file to make a determination as to whether or not the identification information and signature are authentic and valid, and therefore the vote included in the envelope should be counted. If the identification information and signature are deemed to be authentic and valid, the identifying information and signature are separated from the sealed ballot before it is handed to the ballot counters for tabulation. In this manner, the privacy of the voter's selections is maintained and thus the ballot remains a "secret ballot."

One general problem with vote by mail envelopes is the signature is in the open and exposed for all to see throughout the process for determining whether or not the vote is authentic. This leads to potential privacy issues and concerns, e.g., fraudulent usage of a voter's signature. Some jurisdictions have required that such signatures be hidden from plain sight while the envelope is en route from the voter to the registrar's office. This will protect against easy imaging of the signature, such as, for example, with a hand scanner or digital camera, for later impersonation or other fraudulent purposes, e.g., identity theft. To comply with such requirements, envelopes have been proposed that hide the signature with a flap which is removed when the envelope is received at the registrar's office. These solutions, however, require some mechanical manipulation of the envelopes, which is both expensive and increases the risk of accidental tears of the envelope, potentially leading to damage to the ballots contained in the envelopes, exposing the marked ballot before the conclusion of the authentication process (which in some states require the ballot to be counted, regardless of the outcome of the authentication process), or the ability to link the voter with his/her ballot, thereby removing the secret ballot.

Voting by mail is becoming more prevalent, apart from the usual absentee voting, and in some jurisdictions, entire elections are being conducted exclusively by mail. As voting by mail becomes more prevalent, the privacy concerns discussed above are also more prevalent. Thus, there exists a need for efficient methods and systems that can protect the privacy of signatures on ballots sent through the mail while also reducing the risk of damage to the ballots when the signatures are revealed.

SUMMARY OF THE INVENTION

The present invention alleviates the problems associated with the prior art and provides methods and systems that protect the privacy of signatures for ballots sent through the mail while also reducing the risk of damage to the ballots when the signatures are revealed.

In accordance with the present invention, the envelope for returning ballots by mail includes a signature area that preferably includes a signature pad that is reflective to light having a predetermined wavelength. The flap of the envelope includes a window such that when the flap is in a closed position, the window aligns with the signature area. The window is formed of a material that reflects a predominant portion of white light and therefore will appear opaque under normal lighting conditions, but will pass light having the predetermined wavelength and therefore will appear transparent when illuminated with light having the predetermined wavelength. A movable signature stub is positioned on top of the signature area. The side of the signature stub facing the signature area is covered with a material that absorbs light having the predetermined wavelength and will transfer to and adhere to the signature area when pressure is applied to the side of the signature stub that does not face the signature area. The signature stub may be, for example, carbon paper with the carbon side facing the signature area. The voter signs the signature stub, thereby imprinting a signature on the signature area by transferring the material from the signature stub to the signature area, and moves the signature stub away from the signature area. Alternatively, the signature pad may be absorptive to light having the predetermined wavelength, and the material on the side of the signature stub facing the signature area can reflect light having the predetermined wavelength.

The flap of the envelope is then sealed, thereby covering the voter's signature in the signature area with the window of the envelope flap. Since the window appears opaque under normal lighting conditions, the voter's signature will be concealed by the window and thus will not be visible. Upon receipt at the registrar's office (or other official vote tallying location), light having the predetermined wavelength can be directed onto the window, thereby rendering the window transparent. The light will be absorbed (or alternatively reflected) where the signature was imprinted on the signature area and reflected (or alternatively absorbed) elsewhere back through the window of the envelope flap, resulting in the voter's signature being visible. The voter's signature can then be read for comparison with official records to perform the required signature verification to determine validity and authenticity of the ballot. Thus, while the envelope is en route from the voter to the registrar's office, the voter's signature will be concealed from plain view. Viewing of the signature does not require any mechanical manipulation of the envelope or flaps on the envelope, thereby reducing the risk of causing damage to the ballot contained therein. After positive verification of the voter's signature, the ballot can be separated from the envelope and provided to the ballot counters for tabulation.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
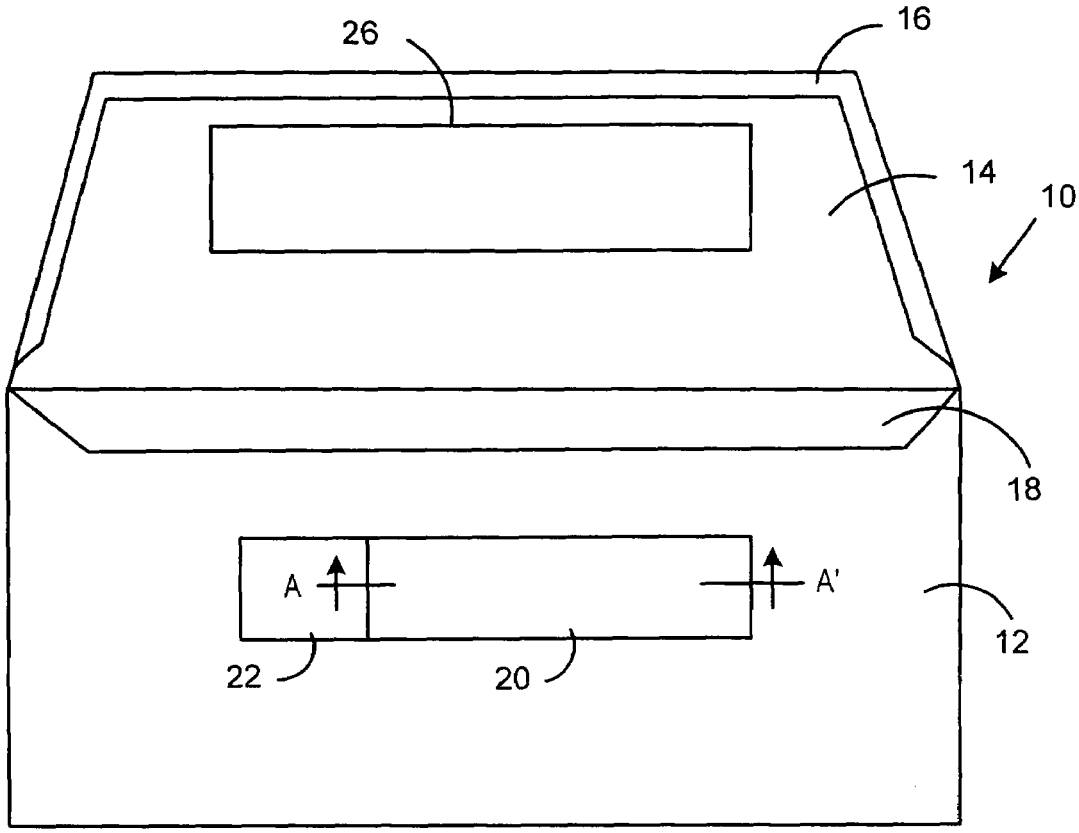
FIG. 1 illustrates an envelope, according to an embodiment of the present invention, for returning ballots by mail in an open position.
Figure 2:
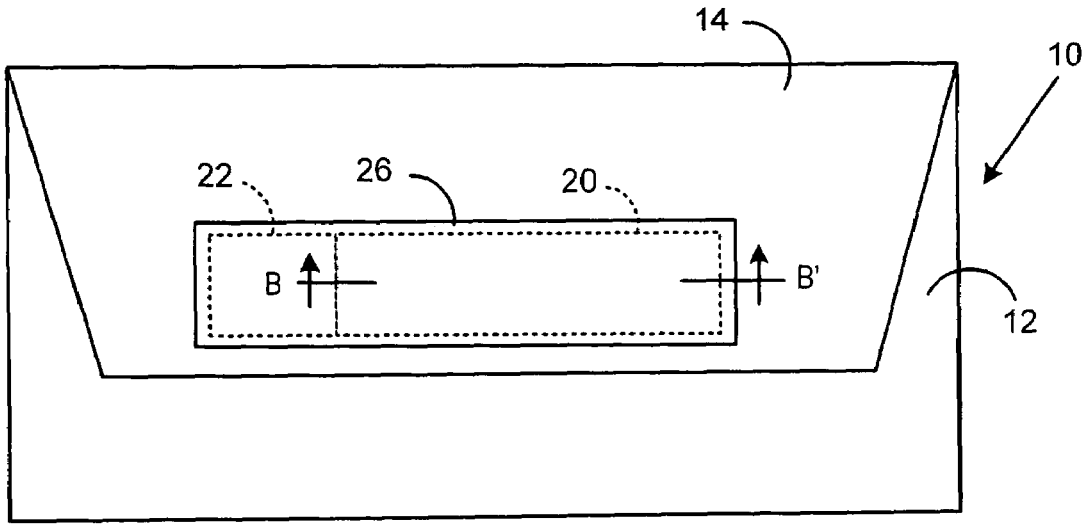
FIG. 2 illustrates the envelope of FIG. 1 in a closed position.

In describing the present invention, reference is made to the drawings, wherein there is seen in FIG. 1 an envelope 10 for returning ballots by mail according to an embodiment of the present invention in an open position. While the present description is directed to an envelope for returning ballots by mail, it should be understood that the invention is not so limited and the envelope 10 could be used to hold any type of communication or material. Envelope 10 includes a body portion 12 and a flap portion 14 connected to the body portion 12. When the flap portion 14 is in an open position as illustrated in FIG. 1, contents, such as, for example, a ballot, can be inserted into a pocket 18 formed by the body portion 12. The flap portion 14 can then be moved to a closed position (as illustrated in FIG. 2), and sealed utilizing a glue or sealing strip 16 which when activated will adhere the flap portion 14 to the body portion 12, thereby covering the pocket 18 and preventing the contents therein from falling out.

The body portion 12 is provided with a signature area 20 intended for the voter's signature. An area for information that identifies the voter 22 may also be provided adjacent to the signature area 20. Such information can include, for example, the voter's name and address, and is preferably provided in some machine readable form such as a barcode. The identification information is preferably printed using an ink that is absorptive of light having a predetermined wavelength W on the body portion 12 of the envelope 10, or alternatively on an adhesive label that the voter applies to the body portion 12 adjacent to the signature area 20 in the identification area 22. The background for the identification information is preferably reflective of light having the predetermined wavelength W. Alternatively, the voter identification information could be printed on the flap portion 14 or elsewhere on the body portion 12 such that it can be viewed when the flap portion 14 is in the closed position as illustrated in FIG. 2.

The flap portion includes a window 26 that corresponds with the signature area 20 and identification area 22 of the body portion 12 when the flap portion 14 is in the closed position. Strip 16 preferably extends along the sides of flap portion 14, thereby preventing access to the signature area 20 and identification area 22 through the side of the flap portion 14. The window is formed from any suitable material, such as, for example, a polymeric film that is impregnated with one or more dyes that will reflect wavelengths other than the predetermined wavelength W. For example, the window 26 could reflect visible wavelengths, e.g., in the range of approximately 400 to 700 nm, but will pass light having wavelength W in the infrared, e.g., wavelength of greater than approximately 750 nm, or ultraviolet range, e.g., wavelength of less than approximately 400 nm, of light. The predetermined wavelength W could also be in the visible range, with the window 26 passing a very narrow band of light near the predetermined wavelength and reflecting light outside that band. As shown in FIG. 2, when the flap portion 14 is folded over the body portion 12, the window 26 covers the signature area 20 (and possibly the identification area 22) on the body portion 12 of the envelope 10. Because of the filtering properties of the window 26, when the window 26 is illuminated by white light, a substantial portion, if not all, of the light will be reflected and the window will appear as opaque. When the window 26 is illuminated by light having the wavelength W, it will pass the light through and appear as clear. The signature in the signature area 20 can then be read as described further below.

Figure 3:
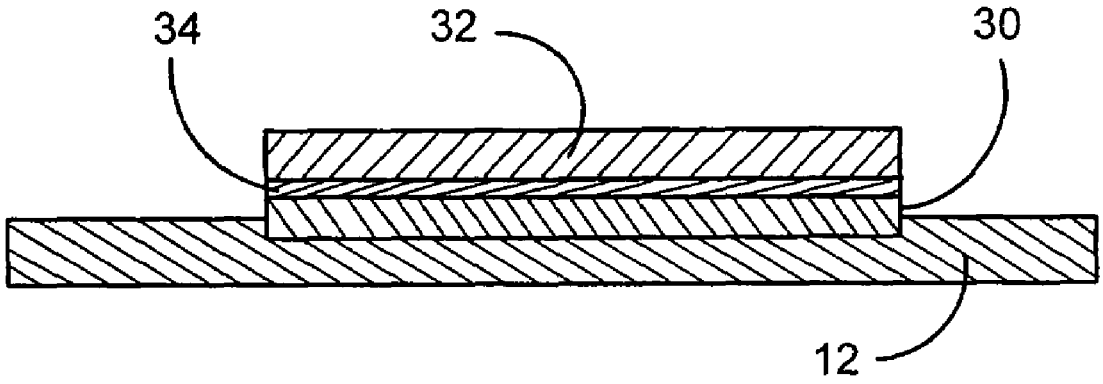
FIG. 3 illustrates a cross-sectional view of the signature area, according to an embodiment of the invention, of the envelope illustrated in FIG. 1 along line A-A'.

FIG. 3 illustrates a cross-sectional view along line A-A' in FIG. 1 of the signature area 20. Signature area 20 preferably includes a signature pad 30 that is formed from a material that is reflective to light having the predetermined wavelength W. The signature pad 30 may be a separate material provided on a label or the like that is applied to the body portion 12, or alternatively may be formed from a material deposited directly to the body portion 12 using a suitable process, such as, for example, ink jet printing or the like. For example, for predetermined wavelengths W in the ultraviolet range, the signature pad 30 could be formed of standard optical brightener dyes deposited on the body portion 12 of the envelope 10. For predetermined wavelengths W in the infrared range, the signature pad 30 could be formed from a laser dye such as IR-125 (Indocyanine Green), IR-132 or IR-140. The use of the signature pad 30 will aid in the reading of a signature as described below. It should be noted, however, that the signature pad 30 is not required if the body portion 12 of the envelope 10 is sufficiently reflective to light having wavelength W.

A signature stub 32 is attached to the body portion 12 of the envelope 10 preferably such that the entire signature stub 32 is within the boundary of the signature pad 30. The signature stub 32 is attached in such a manner that it can be moved, or removed completely, from the signature pad 30. Preferably, the signature stub 32 is removable and can be attached, for example, using a perforated tear strip, removable adhesive, or any other suitable means that will allow the signature stub 32 to be secured in place but easily removed when desired. The side of the stub 32 that faces the signature pad 30 (or body portion 12) is covered with a material 34 that will absorb light of wavelength W and will transfer to and adhere to the signature pad 30 (or body portion 12) when pressure is applied to the stub 32. For wavelengths W in the ultraviolet range and infrared range, the stub 32 and material 34 can be, for example, standard carbon paper with the carbon acting as the material 34. Carbonless copy papers or NCR (No Carbon Required) papers that utilize a microencapsulated dye and reactant to form an image can also be used provided they are selected to absorb light having the predetermined wavelength W. The material 34 could also be formed of, for example, the following components in the following approximate quantities:

| | |
|---|---|
| Methyl Violet | 1.0% |
| Carnauba Wax | 6.0% |
| Montan Wax | 8.0% |
| Kaolin | 12.0% |
| Carbon Black | 15.0% |
| Mineral Oil | 25.0% |
| Paraffin Wax | 33.0% |

Figure 4:
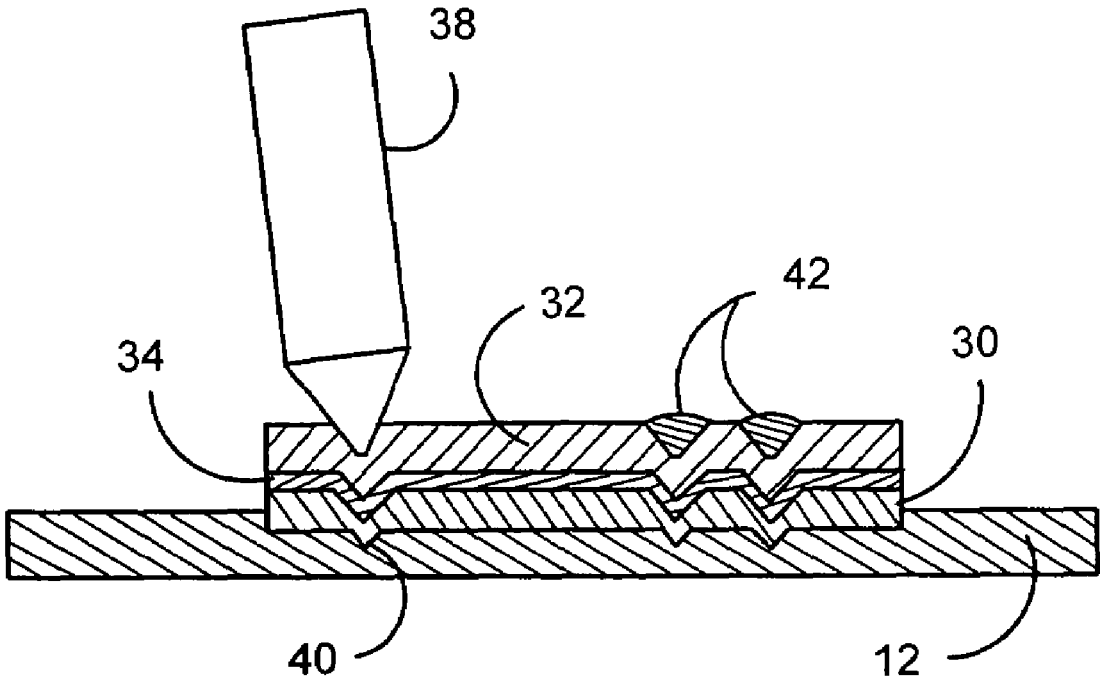
FIG. 4 illustrates the cross-sectional view of the signature area illustrated in FIG. 3 during a signature process.

FIG. 4 illustrates the cross-sectional view of the signature area 20 illustrated in FIG. 3 during the signing process. When a signature tool 38, such as, for example a pen, pencil, stylus or other instrument, is used to sign on top of the stub 32, pressure is applied to the stub 32. The pressure is transferred through the stub 32 and material 34 to the signature pad 30, which may or may not cause small indents 40 in the signature pad 30. Regardless of whether or not indents 40 are made in the signature pad 30 (or body portion 12), the pressure from the signature tool 38 will cause the material 34 to transfer from the stub 32 to the signature pad 30 (or body portion 12). Optionally, the envelope 10 could be pre-printed with an identification number on the signature stub 32 such that the identification number appears on the top surface of the signature stub 32 (illustrated by reference numeral 42 in FIG. 4) and is also transferred, via the material 34, to the signature pad 30 (or body portion 12). The identification numbers can be used by voters to determine if their vote was accepted or rejected for tallying as will be described below.

Figure 5:
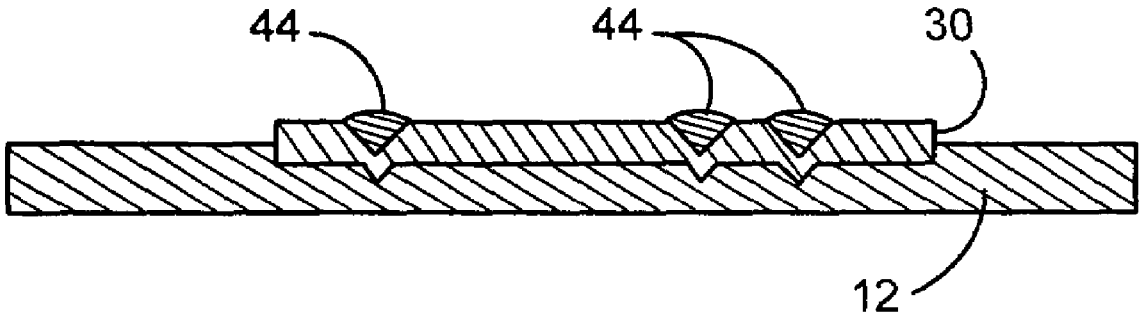
FIG. 5 illustrates the cross-sectional view of the signature area illustrated in FIG. 3 with the movable signature stub removed.

FIG. 5 illustrates the cross-sectional view of the signature area 20 illustrated in FIG. 3 after the stub 32 has been signed and the stub 32 moved such as, for example, by folding the signature stub 32 back on the body portion 12. Preferably, the signature stub 32 is removable and can be separated from the body portion 12. As shown in FIG. 5, the material 34 has been transferred to the signature pad 30 in the areas, denoted by reference numeral 44, where the signature tool 38 exerted pressure to the stub 32 and where the identification number, if provided, was pre-printed. The use of the signature stub 32 and material 34 provides suitable control over the deposition on the signature pad 30 (or body portion 12) when the envelope 10 is signed. As noted above, the window 26 of the flap 14 will only transmit light having a predetermined wavelength W. It is, therefore, preferable that the material with which the signature is captured on the signature pad 30 (or body portion 12) be absorptive of light having a wavelength W to ensure sufficient contrast between the signature and the signature pad 30 (or body portion 12). For example, if the signature was signed with an ink that is partially reflective of light having a wavelength W, it will be difficult (if not impossible) to read the signature when illuminated by light of wavelength W, since both the signature and the signature pad 30 (or body portion 12) will reflect the light. Using the signature stub 32 with the material 34 will ensure that regardless of the signature tool 38 used to sign the envelope 10, the substance deposited on the signature pad 30 (or body portion 12) will be controlled and be absorptive of light having the predetermined wavelength W.

Figure 6:
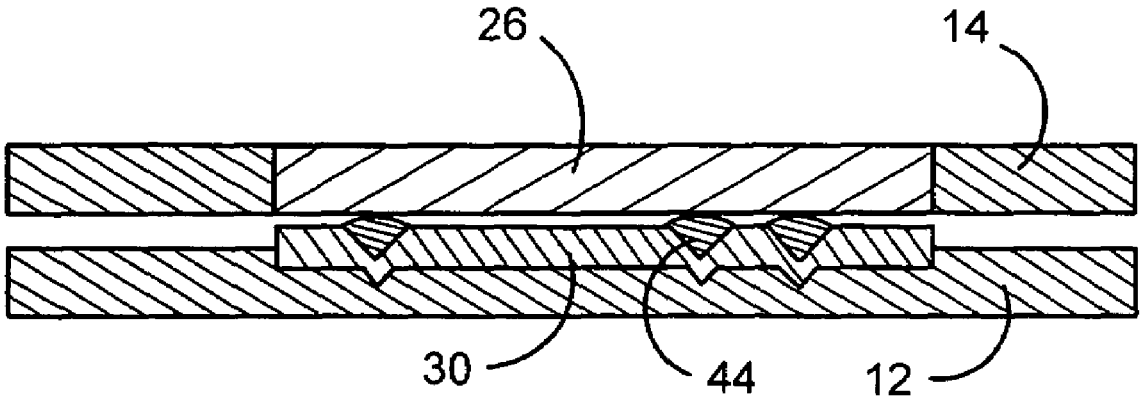
FIG. 6 illustrates a cross-sectional view of the signature area, according to an embodiment of the invention, of the envelope illustrated in FIG. 2 along line B-B'.
Figure 7:
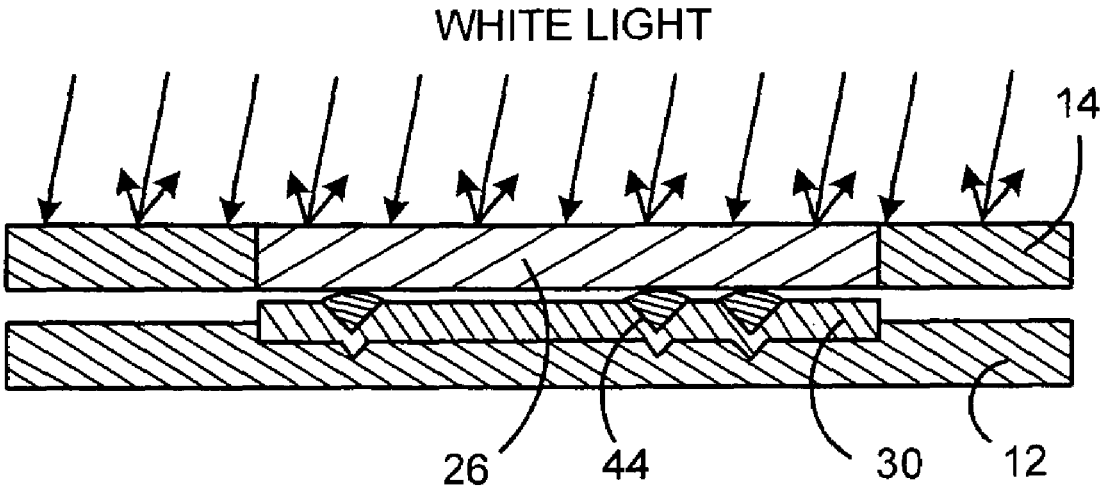
FIG. 7 illustrates the cross-sectional view of the signature area illustrated in FIG. 6 when illuminated by white light.
Figure 8:
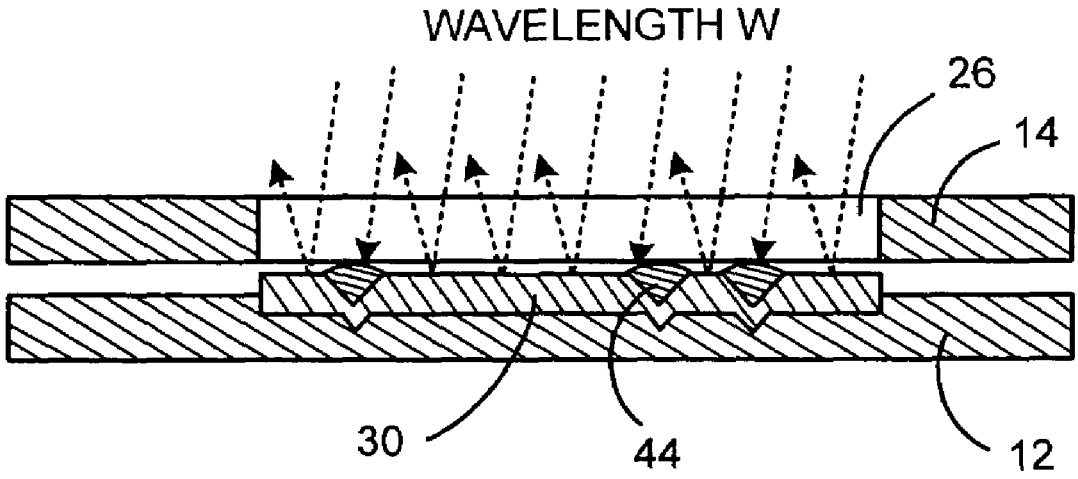
FIG. 8 illustrates the cross-sectional view of the signature area illustrated in FIG. 6 when illuminated by light having the predetermined wavelength.

FIG. 6 illustrates a cross-sectional view along line B-B' in FIG. 2 of the signature area 20. As shown in FIG. 6, the window 26 of flap 14 covers the signature area 20 that includes the signature pad 30 (if provided) and material 34 transferred thereto in the areas 44 (only one location is identified in FIG. 6 for clarity). FIG. 7 illustrates the cross-sectional view of the signature area 20 illustrated in FIG. 6 when illuminated by white light. As can be seen in FIG. 7, when white light strikes the window 26, a substantial portion of the white light is reflected by the window 26, and the window 26 will appear as opaque. Thus, the signature area 20 beneath the window 26 (and the identification area 22 if provided adjacent to the signature area 20) will not be visible and can not be read. FIG. 8 illustrates the cross-sectional view of the signature area 20 illustrated in FIG. 6 when illuminated by light predominantly having the predetermined wavelength W. As can be seen in FIG. 8, light having wavelength W is passed through the window 26 where it will strike either the signature pad 30 (if provided) and the areas 44 where the material 34 is located. The signature pad 30 (or body portion 12), being reflective of light having wavelength W, will reflect the light back up through the window 26. The areas 44, having the material 34 that is absorptive of light having wavelength W, will absorb the light and not reflect it. The areas 44 where the light is absorbed will appear as dark areas, thereby forming an image on the signature pad 30 (or body portion 12) of the signature. The signature can then be read. Similarly, if the identification area 22 is provided adjacent to the signature area 20, the light will be absorbed by the ink used to print the information and reflected elsewhere, thereby forming an image of the identification information that can be read. When the light having wavelength W is removed from the signature area 20, the window 26 will again appear as opaque as described above with respect to FIG. 7, and the signature (and identification information) will no longer be able to be read.

Figure 9:
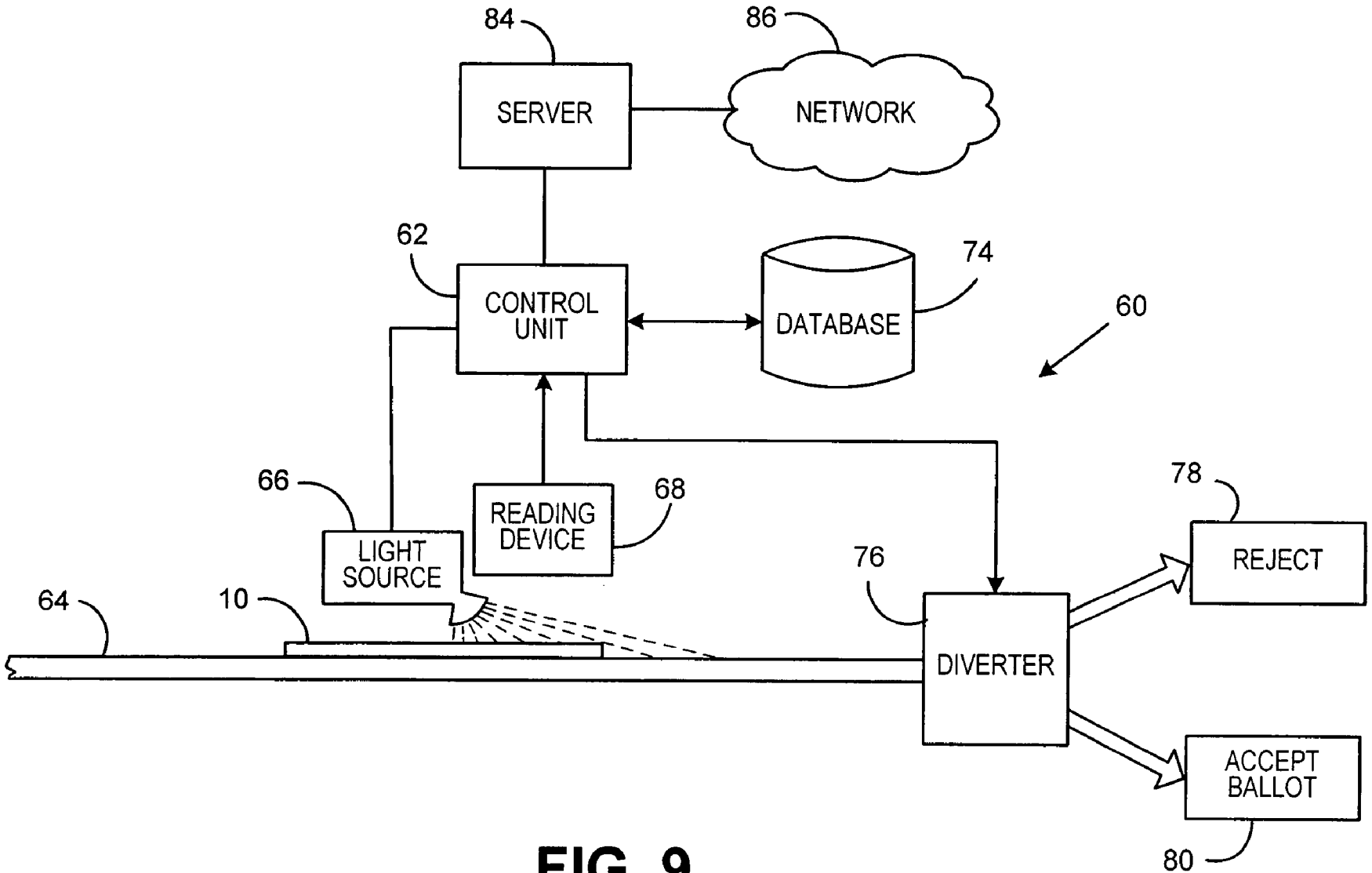
FIG. 9 illustrates in block diagram form a system for viewing the signature according to an embodiment of the present invention.

FIG. 9 illustrates in block diagram form an automated system 60 for viewing the signature concealed using the envelope 10 illustrated in FIGS. 1 and 2 according to an embodiment of the present invention. System 60 includes a control unit 62, such as, for example, a general or special purpose microprocessor or the like, that controls operation of the system 60. Control unit 62 is connected to a database 74, which is used to store voter information, including, for example, name, address, and a reference signature for use in verifying ballots received by mail as described below. A transport 64, such as, for example, rollers and/or belts, is used to transport a series of envelopes 10 (only one shown in FIG. 4) through the system 60. A light source 66 is located adjacent to the transport to illuminate envelope 10 with light having the predetermined wavelength W. A reading device 68, such as, for example, a scanner, camera, or the like is positioned adjacent to the light source 64 such that images of the envelopes 10 can be read while illuminated by the light source 66. Optionally, the light source 66 and reading device 68 can be located in some type of enclosure to limit the amount of outside light (white light) that will illuminate the envelope 10 during the reading process. Alternatively, the reading device 68 could utilize a lens that will capture only light having the wavelength W, thereby removing any interference from outside white light. A diverter 76 is located downstream from the reading device 68 and is coupled to the control unit 62. Based on command signals from the control unit 62, the diverter 76 will divert each envelope to a reject path 78 or an accept ballot path 80 as described below. The control unit 62 of the system 60 could optionally be coupled to a server 84. Server 84 can be coupled to a network 86, such as, for example, the Internet, through which information can be provided from the server 84 to remote locations.

Figure 10:
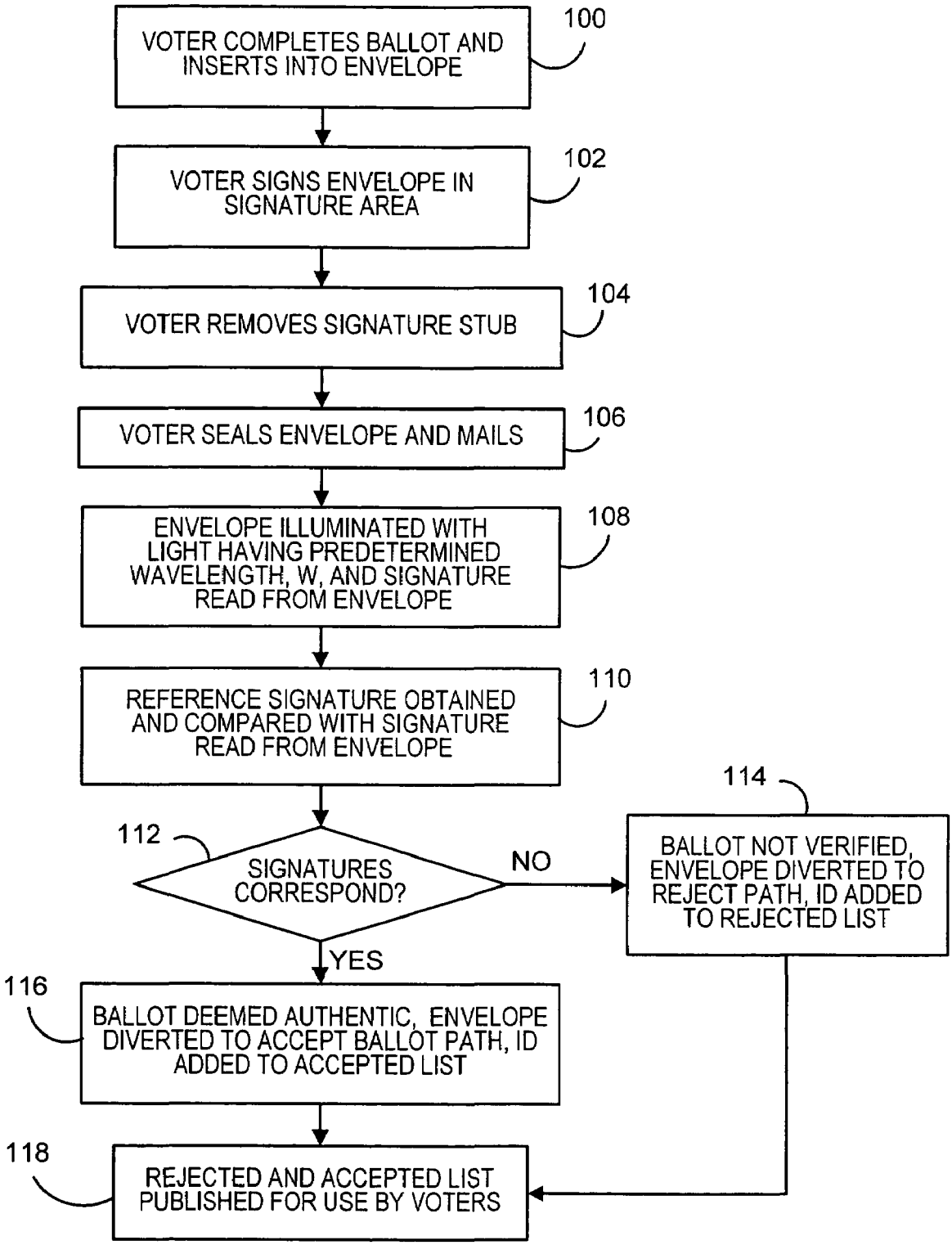
FIG. 10 illustrates in flow diagram form the preparation and processing of an envelope for mailing a ballot according to an embodiment of the present invention.

FIG. 10 illustrates in flow diagram form the preparation and processing of an envelope 10 for mailing a ballot. In step 100, a voter completes a ballot and inserts it into the pocket 18 of envelope 10. In step 102, the voter signs the envelope 10 in the signature area 20 as described above with respect to FIG. 4. In step 104, the voter moves the signature stub 32 away from the signature area 20, such as, for example by folding, or if the signature stub 32 is removable, removes it completely from the body portion 12. In step 106, the voter seals the flap portion 14 to the body portion 12 of the envelope 10, thereby covering the signature area 20 with the window 26 (as described above with respect to FIG. 6), and mails the envelope 10 to the registrar's office. The window 26 will conceal the voter's signature in the signature area 20 under normal, e.g., white light, illumination, as described above with respect to FIG. 7. Thus, the privacy of the voter's signature is maintained during transit of the envelope 10 from the voter to the registrar's office.

Upon receipt of the envelope 10 at the registrar's office, the envelope 10 can be processed using the system as illustrated in FIG. 9. In step 108, the envelope 10 is transported by the transport 64 and illuminated by the light source 66 with light having the predetermined wavelength W. Illumination by light having the wavelength W will result in the voter's signature being revealed as described above with respect to FIG. 8. The reading device 68 can then read the voter's signature in signature area 20 and the identification information from identification area 22 (regardless of where the information is printed on the envelope 10) from the envelope 10. If the envelope 10 was pre-printed with an identification number, the identification number can also be read from the signature pad 30 (or body portion 12). In step 110, the control unit 62 can retrieve the reference signature from the database 74 (based on the identification information included on the envelope 10 for the voter) and compare the reference signature to the signature read from signature area 20 of envelope 10. In step 112, it is determined if the reference signature retrieved from the database 74 corresponds to the signature read from signature area 20 of envelope 10. If the signatures do not correspond, then in step 114 the ballot is rejected as not being verified and the envelope 10 is diverted by the diverter 76 to the reject path 78. If an identification number was also read from the envelope 10, then the control unit 62 can add the identification number of the envelope 10 to a reject list maintained by the server 84. Envelopes diverted to the reject path may be subject to some type of manual human inspection to make a final determination if the vote should be counted or not. If in step 112 it is determined that the signatures do correspond, then in step 116 the ballot is deemed to be authentic and verified and the envelope 10 is diverted by the diverter 76 to the accept ballot path 80, in which the ballot will be given to ballot counters for tabulation. If an identification number was also read from the envelope 10, then the control unit 62 can add the identification number of the envelope 10 to an accepted list maintained by the server 84. Preferably, the ballot is removed from the envelope 10 before being given to the ballot counters thereby maintaining a "secret ballot."

Optionally, if identification numbers were read from the envelopes 10 during processing, then in step 118 the server 84 can publish the reject and accepted lists, via the network 86, such that a voter can determine if his or her vote was accepted or rejected. Using the identification number printed on the signature stub 32 that was removed by the voter, as described with respect to step 104 before mailing the envelope 10, the voter can access the lists published by the server 84 and determine upon which list the identification number for his or her respective envelope 10 is located. Thus, each voter can easily confirm if his or her ballot was accepted or rejected during processing of the envelope 10.

Figure 11:
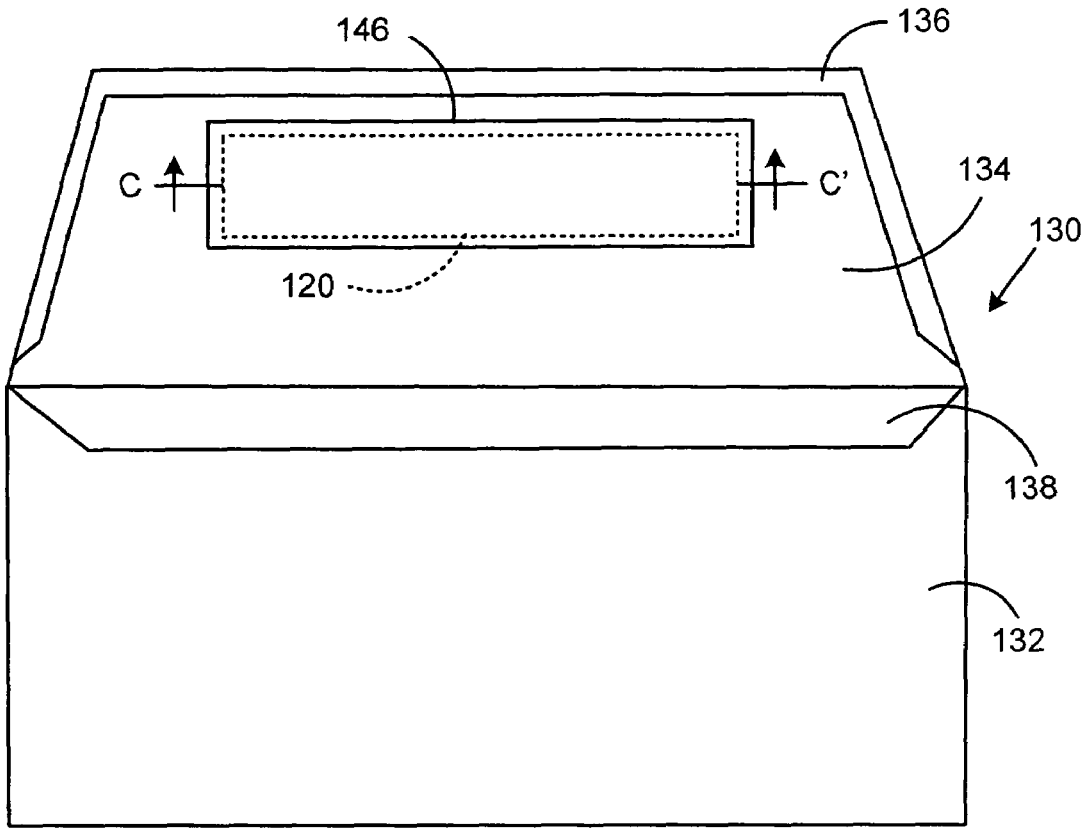
FIG. 11 illustrates an envelope, according to another embodiment of the present invention, for returning ballots by mail in an open position.
Figure 12:
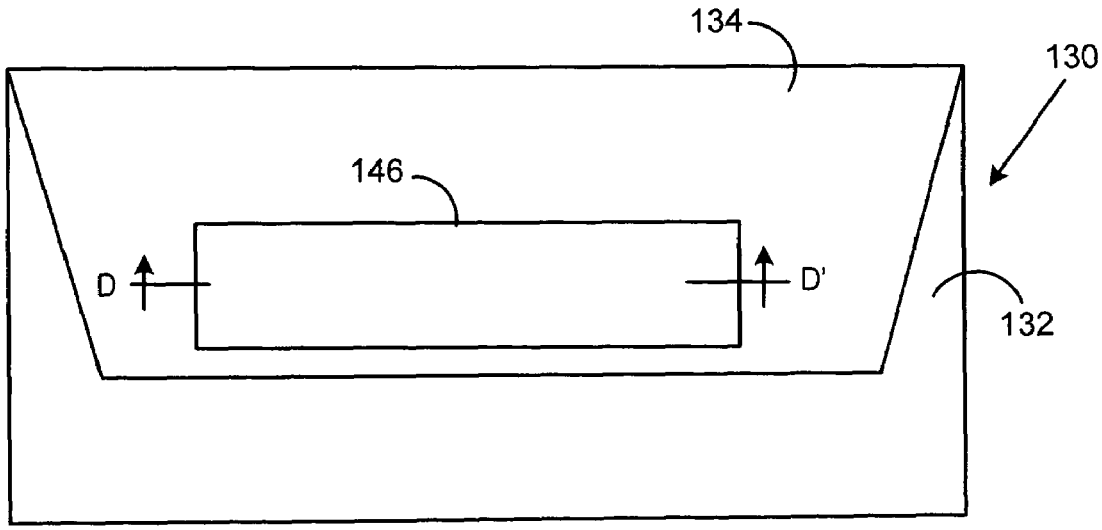
FIG. 12 illustrates the envelope of FIG. 11 in a closed position.

FIG. 11 illustrates an envelope 130 for returning ballots by mail according to another embodiment in an open position. Envelope 130 includes a body portion 132 and a flap portion 134 connected to the body portion 132. When the flap portion 134 is in an open position as illustrated in FIG. 11, contents, such as, for example, a ballot, can be inserted into a pocket 138 formed by the body portion 132. The flap portion 134 can then be moved to a closed position (as illustrated in FIG. 12), and sealed utilizing a glue or sealing strip 136 which when activated will adhere the flap portion 134 to the body portion 132. The flap portion 134 includes a window 136 that is similar to the window 26 described with respect to envelope 10 of FIG. 1. In the embodiment illustrated in FIG. 11, a signature area 120 for the voter to sign is located on the inside of the window 136 (the side shown in FIG. 11).

Figure 13:
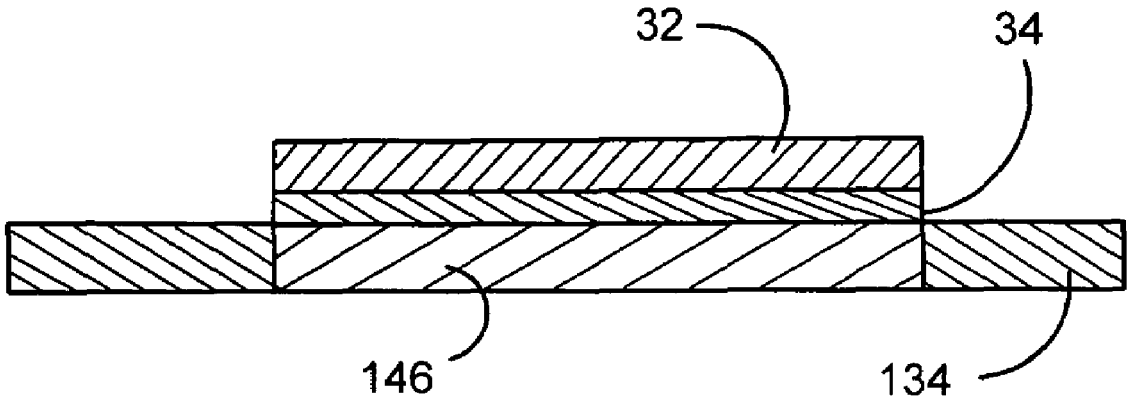
FIG. 13 illustrates a cross-sectional view of the signature area of the envelope illustrated in FIG. 11 along line C-C'.

FIG. 13 illustrates a cross-sectional view along line C-C' in FIG. 11 of the signature area 120. A signature stub 32, as described previously with respect to FIG. 3, is attached to the flap portion 134 of the envelope 130 preferably such that the entire signature stub 32 is within the boundary of the window 146. The signature stub 32 is attached in such a manner that it can be moved, or removed completely, from the flap portion 134 as previously described. The signature stub 32 can be attached directly to the flap portion 134 or to the window 146 of the flap portion 134. The side of the stub 32 that faces the window 146 is covered with the material 34 as previously described that will transfer to and adhere to the inside of the window 146 when pressure is applied to the stub 32 (similarly as described with respect to FIGS. 4 and 5). Thus, the voter's signature will be captured on the inside of the window 146.

Figure 14:
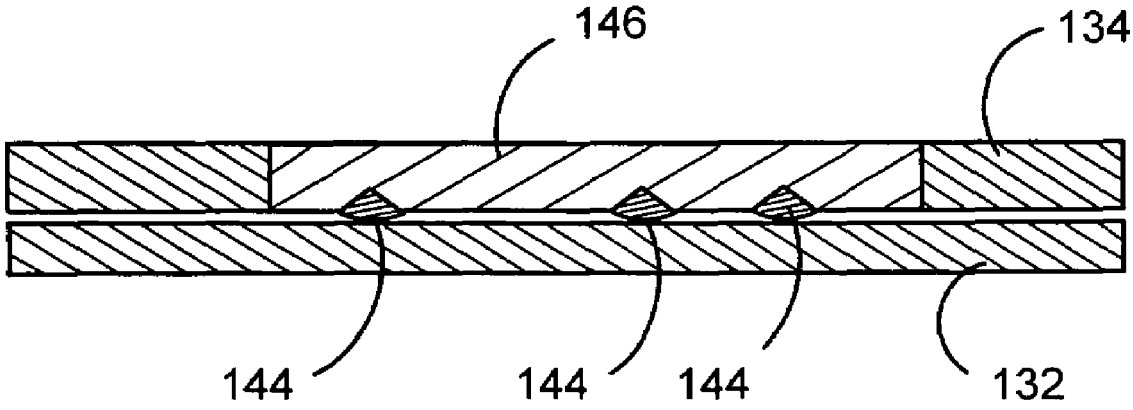
FIG. 14 illustrates a cross-sectional view of the signature area of the envelope illustrated in FIG. 12 along line D-D'.

FIG. 14 illustrates a cross-sectional view along line D-D' in FIG. 12 of the signature area 120 after the voter has signed and moved the stub 32 (similarly as described above), and sealed the envelope 130. As shown in FIG. 14, the material 34 has transferred to and adheres, in the areas 144, to the inside of the window 146 of flap 134. The body portion 132 of the envelope 130 provides a background beneath the window 146, and is preferably formed from, or includes an area aligned with the window 146 that is formed from a material that is reflective to light having the predetermined wavelength W. The processing of the envelope 130 can be performed by the system described with respect to FIG. 9 using the method described with respect to FIG. 10. When white light strikes the window 146, a substantial portion, if not all, of the white light is reflected by the window 146, and the window 146 will appear as opaque, similarly as described with respect to FIG. 7. Thus, the signature area 120 beneath the window 146 will not be visible and can not be read. When light having wavelength W strikes the window 146, it will pass through where it will strike the body portion 132 and the areas 44 where the material 34 is located. The body portion 132, being reflective of light having wavelength W, will reflect the light back up through the window 146. The areas 44, having the material 34 that is absorptive of light having wavelength W, will absorb the light and not reflect it. The areas 44 where the light is absorbed will appear as dark areas, thereby forming an image on the window 146 of the signature (oriented upside down and reversed). The signature can then be read and re-oriented, through standard image processing, and compared to the obtained reference signature similarly as described above.

It should be noted that while the present invention was described above as having the background, e.g., signature pad 30, or body portion 12 or 132, reflective of light having wavelength W and the material 34 absorptive of light having wavelength W, the invention is not so limited and as an alternative the background could be absorptive of light having wavelength W and the material 34 reflective of light having wavelength W. In this situation, the signature will appear as a reverse image, i.e., the background (signature pad 30 or body portion 12 or 132) will absorb the light and the areas 44 will reflect the light, thereby forming an image of the signature which can then be read. For example, the background could be formed by a dye that is carbon black based, while the material 34 could be formed of titanium dioxide or other similarly reflective material.

It should also be noted that the location and orientation of the window need not be as shown and the window can be located and oriented in any position on the envelope. For example, the window could be located along the bottom edge of the envelope, or oriented vertically along a side edge of the envelope.

Thus, according to the present invention, methods and systems that protect the privacy of signatures on ballots sent through the mail are provided. Those skilled in the art will also recognize that various modifications can be made without departing from the spirit of the present invention. While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. An envelope comprising:

a body portion having a pocket for holding contents, the body portion including a predefined area for a person's signature to be provided on the body portion, the predefined area being reflective of light having a predetermined wavelength;

a movable stub attached to the body portion, at least a portion of the movable stub covering the predefined area for the person's signature to be provided on the body portion, the movable stub having a first side that faces the predefined area that includes a material that will transfer to the body portion in the predefined area when pressure is applied to a second side of the movable stub that is opposite to the first side, the material absorbing light having the predetermined wavelength, and a flap portion connected to the body portion for covering the pocket when the flap portion is in a closed position, the flap portion including a window that corresponds with the predefined area of the body portion when the flap is in the closed position such that the predefined area is covered by the window, the window passing light having the predetermined wavelength and reflecting light that does not have the predetermined wavelength.

2. The envelope according to claim 1, wherein the predefined area includes a pad that is reflective of light having the predetermined wavelength.

3. The envelope according to claim 2, wherein the pad is formed from a dye.

4. The envelope according to claim 1, wherein the movable stub is carbon paper.

5. The envelope according to claim 1, wherein the material includes a microencapsulated dye and reactant.

6. The envelope according to claim 1, wherein the movable stub is removable from the body portion.

7. The envelope according to claim 6, wherein the movable stub includes an identification number.

8. An envelope comprising:

a body portion having a pocket for holding contents, the body portion including a predefined area for a person's signature to be provided on the body portion, the predefined area being absorptive of light having a predetermined wavelength;

a movable stub attached to the body portion, at least a portion of the movable stub covering the predefined area for the persona's signature to be provided on the body portion, the movable stub having a first side that faces the predefined area that includes a material that will transfer to the body portion in the predefined area when pressure is applied to a second side of the movable stub that is opposite to the first side, the material reflecting light having the predetermined wavelength, and a flap portion connected to the body portion for covering the pocket when the flap portion is in a closed position, the flap portion including a window that corresponds with the predefined area of the body portion when the flap is in the closed position such that the predefined area is covered by the window, the window passing light having the predetermined wavelength and reflecting light that does not have the predetermined wavelength.

9. The envelope according to claim 8, wherein the predefined area includes a pad that is absorptive of light having the predetermined wavelength.

10. The envelope according to claim 8, wherein the movable stub is removable from the body portion.

11. The envelope according to claim 10, wherein the movable stub includes an identification number.

12. An envelope comprising:

a body portion having a pocket for holding contents, the body portion including an area reflective of light having a predetermined wavelength;

a flap portion connected to the body portion for covering the pocket when the flap portion is in a closed position, the flap portion including a window that corresponds with the reflective area of the body portion when the flap is in the closed position, the window having a first side that faces the body portion when the flap portion is in the closed position, the first side of the window including an area for a person's signature to be provided on the window, the window passing light having the predetermined wavelength and reflecting light that does not have the predetermined wavelength; and a movable stub attached to the flap portion and aligned with the window, the movable stub having a first side that faces the first side of the window that includes a material that will transfer to the fist side of the window when pressure is applied to a second side of the movable stub that is opposite to the first side of the movable stub, the material absorbing light having the predetermined wavelength.

13. The envelope according to claim 12, wherein the movable stub is attached to the first side of the window.

14. The envelope according to claim 12, wherein the movable stub is carbon paper.

15. The envelope according to claim 12, wherein the material includes a microencapsulated dye and reactant.

16. The envelope according to claim 12, wherein the movable stub is movable from the flap portion.

17. The envelope according to claim 16, wherein the movable stub includes an identification number.

18. An envelope comprising:

a body portion having a pocket for holding contents, the body portion including an area absorptive of light having a predetermined wavelength;

a flap portion connected to the body portion for covering the pocket when the flap portion is in a closed position, the flap portion including a window that corresponds with the absorptive area of the body portion when the flap is in the closed position, the window having a first side that faces the body portion when the flap portion is in the closed position, the first side of the window including an area for a person's signature to be provided on the window, the window passing light having the predetermined wavelength and reflecting light that does not have the predetermined wavelength; and a movable stub attached to the flap portion and aligned with the window, the movable stub having a first side that faces the first side of the window that includes a material that will transfer to the fist side of the window when pressure is applied to a second side of the movable stub that is opposite to the first side of the movable stub, the material reflecting light having the predetermined wavelength.

19. The envelope according to claim 18, wherein the movable stub is attached to the first side of the window.

20. The envelope according to claim 18, wherein the movable stub is removable from the flap portion.

21. The envelope according to claim 20, wherein the movable stub includes an identification number.

22. A method for processing a ballot received from a voter in an envelope, the envelope including information associated with the voter that is covered by a window, the window passing light having a predetermined wavelength and blocking light that does not have the predetermined wavelength, the method comprising:

illuminating the envelope with light having the predetermined wavelength to reveal the information associated with the voter that is covered by the window;

reading the information from the envelope, the information from the envelope including a signature of the voter;

comparing the signature of the voter read from the envelope with a reference signature to determine authenticity of the ballot; and if the signature of the voter read from the envelope compares favorably with the reference signature, accepting the ballot as authentic.

23. The method according to claim 22, wherein the information read from the envelope further includes identification information associated with the voter; and the method further comprises:

obtaining the reference signature from a database based on the identification information associated with the voter that is read from the envelope.

24. The method according to claim 22, wherein the information read from the envelope includes an identification number, and the method further comprises:

publishing a list indicating if the envelope, based on the identification number, was accepted as authentic.

25. The method according to claim 22, wherein if the signature of the voter read from the envelope does not compare favorably with the reference signature, the method further comprises:

rejecting the ballot.

* * * * *